US008028961B2

(12) United States Patent
Ashraf et al.

(10) Patent No.: US 8,028,961 B2
(45) Date of Patent: Oct. 4, 2011

(54) VITAL SOLID STATE CONTROLLER

(75) Inventors: Ahtasham Ashraf, Madison, WI (US); David Baldwin, Madison, WI (US)

(73) Assignee: Central Signal, LLC, Madison, WI (US)

( * ) Notice: Subject to any disclaimer, the term of this patent is extended or adjusted under 35 U.S.C. 154(b) by 691 days.

(21) Appl. No.: 11/964,606

(22) Filed: Dec. 26, 2007

(65) Prior Publication Data

US 2008/0183306 A1 Jul. 31, 2008

Related U.S. Application Data

(60) Provisional application No. 60/871,609, filed on Dec. 22, 2006, provisional application No. 60/884,930, filed on Jan. 15, 2007.

(51) Int. Cl.
*B61L 3/12* (2006.01)

(52) U.S. Cl. ..... 246/167 R

(58) Field of Classification Search ..... 246/20, 246/27, 34 R, 35, 41, 122 R, 167 R, 176
See application file for complete search history.

(56) References Cited

U.S. PATENT DOCUMENTS

| | | | |
|---|---|---|---|
| 847,105 | A | 3/1907 | Parrish, Jr. |
| 2,664,499 | A | 12/1953 | Muse |
| 3,810,119 | A | 5/1974 | Zieve et al. |
| 3,816,796 | A | 6/1974 | Molloy |
| 3,974,991 | A | 8/1976 | Geiger |
| 4,103,303 | A | 7/1978 | Regenos et al. |
| 4,196,412 | A | 4/1980 | Sluis et al. |
| 4,250,483 | A | 2/1981 | Rubner |
| 4,251,041 | A | 2/1981 | Svet |
| 4,307,860 | A | 12/1981 | Kuhn |
| 4,324,376 | A | 4/1982 | Kuhn |
| 4,361,301 | A | 11/1982 | Rush |
| 4,365,777 | A | 12/1982 | Geiger |
| 4,449,115 | A | 5/1984 | Koerner |
| 4,581,700 | A | 4/1986 | Farnham et al. |
| 4,703,303 | A | 10/1987 | Snee |
| 4,711,418 | A | 12/1987 | Aver, Jr. |
| 4,727,372 | A | 2/1988 | Buttemer |
| 4,787,581 | A | 11/1988 | Dobler et al. |
| 4,906,979 | A | 3/1990 | Kimura |
| 4,934,633 | A | 6/1990 | Ballinger et al. |
| 5,006,847 | A | 4/1991 | Rush et al. |

(Continued)

FOREIGN PATENT DOCUMENTS

DE 195 32 640 A1 2/1997

(Continued)

OTHER PUBLICATIONS

Caruso, M. et al, "Vehicle Detection and Compass Applications using AMR Magnetic Sensors," 13 pgs, www.ssec.honeywell.com.

(Continued)

*Primary Examiner* — Joe Morano, IV
*Assistant Examiner* — R. J. McCarry, Jr.
(74) *Attorney, Agent, or Firm* — Sylke Law Offices, LLC; C Thomas Sylke

(57) ABSTRACT

A vital programmable logic device (VPD) is provided having at least two microprocessors. The VPD is configured to provide failsafe operation of a vital control system while operating in a closed circuit environment. In at least one embodiment of the present invention, railroad grade crossing signals are controlled by the VPD.

17 Claims, 6 Drawing Sheets

U.S. PATENT DOCUMENTS

| | | | | |
|---|---|---|---|---|
| 5,050,823 | A | 9/1991 | Parker | |
| 5,098,044 | A | 3/1992 | Petit et al. | |
| 5,153,525 | A | 10/1992 | Hoekman et al. | |
| 5,278,555 | A | 1/1994 | Hoekman | |
| 5,281,965 | A | 1/1994 | Hoekman et al. | |
| 5,361,064 | A | 11/1994 | Hamer et al. | |
| 5,417,388 | A | 5/1995 | Stillwell | |
| 5,437,422 | A | 8/1995 | Newman | |
| 5,491,475 | A | 2/1996 | Rouse et al. | |
| 5,504,860 | A | 4/1996 | George et al. | |
| 5,508,698 | A | 4/1996 | Hoekman | |
| 5,590,855 | A | 1/1997 | Kato et al. | |
| 5,620,155 | A | 4/1997 | Michalek | |
| 5,734,338 | A | 3/1998 | Hoekman et al. | |
| 5,737,173 | A | 4/1998 | Ross et al. | |
| 5,751,225 | A | 5/1998 | Fedde et al. | |
| 5,850,192 | A | 12/1998 | Turk et al. | |
| 5,868,360 | A | 2/1999 | Bader et al. | |
| 5,924,652 | A | 7/1999 | Ballinger et al. | |
| 5,954,299 | A | 9/1999 | Pace | |
| 6,232,887 | B1 | 5/2001 | Carson | |
| 6,241,197 | B1 | 6/2001 | Harland | |
| 6,290,187 | B1 | 9/2001 | Egami | |
| 6,292,112 | B1 | 9/2001 | Bader et al. | |
| 6,342,845 | B1 | 1/2002 | Hilliard et al. | |
| 6,386,486 | B1 | 5/2002 | Speranza | |
| 6,457,682 | B2 | 10/2002 | Anderson et al. | |
| 6,519,512 | B1 | 2/2003 | Haas et al. | |
| 6,604,031 | B2 | 8/2003 | Oguma et al. | |
| 6,641,091 | B1 | 11/2003 | Hilleary | |
| 6,683,540 | B1 | 1/2004 | Harrison | |
| 6,688,561 | B2 | 2/2004 | Mollet et al. | |
| 6,799,097 | B2 | 9/2004 | Villarreal Antelo et al. | |
| 6,828,920 | B2 | 12/2004 | Owen et al. | |
| 6,828,956 | B2 | 12/2004 | Notagashira | |
| 6,829,526 | B2 | 12/2004 | Oguma et al. | |
| 7,075,427 | B1 * | 7/2006 | Pace et al. | 340/539.22 |
| 7,254,467 | B2 | 8/2007 | Fries et al. | |
| 7,548,032 | B2 * | 6/2009 | Alton et al. | 318/52 |
| 7,575,202 | B2 | 8/2009 | Sharkey et al. | |
| 7,577,502 | B1 * | 8/2009 | Henry et al. | 701/19 |
| 2001/0022332 | A1 | 9/2001 | Harland | |
| 2002/0049520 | A1 | 4/2002 | Mays | |
| 2002/0185571 | A1 | 12/2002 | Bryant et al. | |
| 2004/0088923 | A1 | 5/2004 | Burke | |
| 2004/0119587 | A1 | 6/2004 | Davenport et al. | |
| 2004/0181321 | A1 | 9/2004 | Fries et al. | |
| 2004/0201486 | A1 | 10/2004 | Knowles et al. | |
| 2004/0249571 | A1 | 12/2004 | Blesener et al. | |
| 2004/0261533 | A1 | 12/2004 | Davenport et al. | |
| 2005/0137759 | A1 * | 6/2005 | Peltz et al. | 701/19 |
| 2005/0237215 | A1 | 10/2005 | Hatfield et al. | |
| 2005/0284987 | A1 | 12/2005 | Kande et al. | |
| 2006/0272539 | A1 | 12/2006 | Clavel | |
| 2008/0169385 | A1 | 7/2008 | Ashraf et al. | |
| 2010/0108823 | A1 | 5/2010 | Barnes | |

FOREIGN PATENT DOCUMENTS

| | | | |
|---|---|---|---|
| DE | 10 2004 035 901 | A1 | 3/2006 |
| DE | 20 2005 020 802 | U1 | 3/2007 |
| EP | 1 832 849 | A2 | 9/2007 |
| JP | 4321467 | | 11/1992 |
| JP | 106994 | A | 1/1998 |
| JP | 2003002207 | | 1/2003 |
| WO | 9725235 | | 7/1997 |
| WO | WO 2006/051355 | A1 | 5/2006 |
| WO | 2008080169 | | 7/2008 |
| WO | 2008080175 | | 7/2008 |

OTHER PUBLICATIONS

Honeywell, "Application Note—AN218—Vehicle Detection Using AMR Sensors," www.honeywell.com, 10 pgs, Aug. 2005.

Honeywell, "Smart Digital Magnetometer," www.magneticsensors.com, 12 pgs, 900139 Feb. 2004 Rev. H.

Safety Now, "Allen-Bradley 6556 Micrologix Clutch/Brake Controller for Mechanical Stamping Presses," Apr. 2001, 4 pgs, www.ab.com/safety/safety_now/april01, obtained from website May 25, 2006.

Safety Now, "Back to School," article by Frank Watkins and Steve Dukich, www.ab.com/safety/safety_now/april01/back_school, 4 pgs, obtained from website May 25, 2006.

Wheatstone Bridge, www.geocities.com/CapeCanaveral/8341/bridge.htm?20061, 1 pg, obtained from website May 1, 2006.

Wheatstone Bridge, http://en.wikipedia.org/wiki/Wheatstone_bridge, 3 pgs, obtained from website May 1, 2006.

Wheatstone Bridge, "Measure an Unknown Resistance," www.dwiarda.com/scientific/Bridge.html, 1 pg, obtained from website May 1, 2006.

Chandra, V and Verma, M. R., "A fail-safe interlocking system for railways," Design & Test of Computers, (Jan./Mar. 1991), 8(1):58-66 (abstract only).

Honeywell, "1- and 2-axis magnetic sensors: HMC1001/1002; HMC1021/1022," Apr. 2000, pp. 1-15.

3M, "Canoga Vehicle Detection System, Advanced Traffic Products: The solution beneath the surface," 4 pgs, obtained from Internet at: www.advancedtraffic.com/3mcanoga-pl.htm, Sep. 27, 2005.

3M, "Canoga Vehicle Detection System: A matched component system for vehicle counting," 3M Intelligent Transportation Systems, 2 pgs, 1998.

3M, Canoga Vehicle Detection System: Non-invasive Microloop model 702, 3M Intelligent Transportation Systems, 4 pgs, 1997.

3M, Canoga Vehicle Detection System, list of products, obtained from Internet at: http://products3.3m.com/catalog/us/en001/safety/traffic_control/node_GSTYGYSDV5be/r..., Sep. 27, 2005.

3M, Canoga Vehicle Detection System: C800 interface and data acquisition software (C800 IS), and C800 vehicle detectors, (product features), 3M Intelligent Transportation Systems, 7 pgs, date unknown.

Trafinfo Communications, Inc., "Trafmate 6: Wireless telemetry for traffic monitoring," 2 pgs, date unknown.

Notification of Transmittal of the International Search Report and the Written Opinion of the International Searching Authority for International Application No. PCT/US2007/088849 (1 pg).

International Search Report, International Application No. PCT/US2007/088849 (2 pgs).

Written Opinion of the International Searching Authority, International Application No. PCT/US2007/088849 (6 pgs).

Notification of Transmittal of the International Search Report and the Written Opinion of the International Searching Authority for International Application No. PCT/US2008/051099 (1 pg).

International Search Report, International Application No. PCT/US2008/051099 (3 pgs).

Written Opinion of the International Searching Authority, International Application No. PCT/US2008/051099 (5 pgs).

Extended European Patent Office Search Report, EPO Application No. 07 866 027.1 (10 pgs).

EPO Machine Translation of DE 195 32 640 A1 (6 pages).

EPO Machine Translation of DE 10 2004 035 901 A1 (5 pages).

Extended European Patent Office Search Report, EPO Application No. 08 727 699.4 (5 pgs).

* cited by examiner

B
N
POWER INPUT
DC/DC Converter 52
DC/DC Converter 54
CONTROLLER 1 12
CONTROLLER 2 14
CONTROLLER 3 34
32
Health Check
VITAL INPUT #1 16
VITAL INPUT #2 18
VITAL INPUT #3 20
VITAL INPUT #N 22
VITAL OUTPUT #1 24
VITAL OUTPUT #2 26
VITAL OUTPUT #3 28
VITAL OUTPUT #N 30
RELAY
Memory 38
COMM 36
RTC 40
GPS 48
RADIO 46
Bluetooth 50
Keypad/ Display 44

VITAL SOLID STATE CONTROLLER

CROSS REFERENCE TO RELATED APPLICATIONS

This application claims priority to U.S. Provisional Application Ser. No. 60/871,609, filed Dec. 22, 2006 and U.S. Provisional Application Ser. No. 60/884,930, filed Jan. 15, 2007, each application is fully incorporated by reference herein.

The present invention relates to supervisory control systems. More specifically the present invention relates to an improved and cost effective vital programmable logic controller system.

BACKGROUND OF THE INVENTION

Conventional programmable logic controllers (PLC) are prevalent in various industries since they can provide a means for intelligently controlling, among other things, mechanical and electrical processes. Consistency and reliability of specific types of PLCs affects their use within process control applications. It is common for known PLCs to be sufficiently functional for a variety of uses, including traffic control, production and assembly lines, and electromechanical machinery control. However, PLCs have not been deemed suitable for use in railroad signal systems based in part upon the non-vital nature of known PLCs.

Railroad grade crossings often involve motor vehicle traffic that cross railroad tracks, the situs of which is notorious for motor vehicle-train collisions. A variety of warning systems intended to warn vehicle operators of approaching trains have employed two major warning systems. These major warning systems include an audible signal sent from the train itself and a visual warning signal located at the site of the grade crossing. The visual warning system almost always includes passive markings (road signs, roadway painted markings, etc.), but active markings (drop down gates, flashing lights, etc.) are not always employed.

Visual railroad signaling device functionality is often governed by national and/or local governing body signaling standards. By example, within the United States, any device designed for railroad signal service must conform to established federal, state and railroad signal standards for design and operation of the signaling devices. It is often the case that an audible signal and/or passive warning methods are not sufficient to provide a motor vehicle operator with sufficient time to avoid a collision. In the case of those crossings that do not have an active vital and preemptive visual warning system, the likelihood of a collision is increased significantly. It is therefore advantageous to provide an active vital and preemptive visual warning system. However, it is cost prohibitive for every grade crossing to have an active vital and preemptive warning system that adheres to the local signaling standards. It is advantageous to provide a cost effective active vital and preemptive warning system.

Railroad signal standard practice for the design and function of signal systems is based upon the concept of a vital system. A vital system is often characterized as being failsafe and consistent with the closed circuit principle. A signal design is failsafe if the failure of any element of the system causes the system to revert to its safest condition. Operation at the safest condition is often activation of the warning system. In the case of railroad signal systems, failsafe design requires that if any element of the active system cannot perform its intended function that the active crossing warning devices will operate and continue to operate until the failure is repaired. In the case of railroad wayside signal systems, failsafe design requires that if any element necessary to the safe and proper operation of the system cannot perform its intended function that the system will revert to the safest condition, i.e. a red signal indicating stop or proceed at restricted speed according to rules is in effect. A signal design is in conformance with the closed circuit principle when the components of the system do not share elements which could afford alternative energy or logic paths, as these elements would violate the failsafe principle. It would be highly advantageous to employ cost effective and failsafe vehicle detection systems using microprocessors or PLCs.

BRIEF DESCRIPTION OF THE DRAWINGS

Preferred embodiments of the invention are described below with reference to the following accompanying drawings, which are for illustrative purposes only. Throughout the following views, reference numerals will be used in the drawings, and the same reference numerals will be used throughout the several views and in the description to indicate same or like parts.

DETAILED DESCRIPTION OF THE INVENTION

Figure 1:
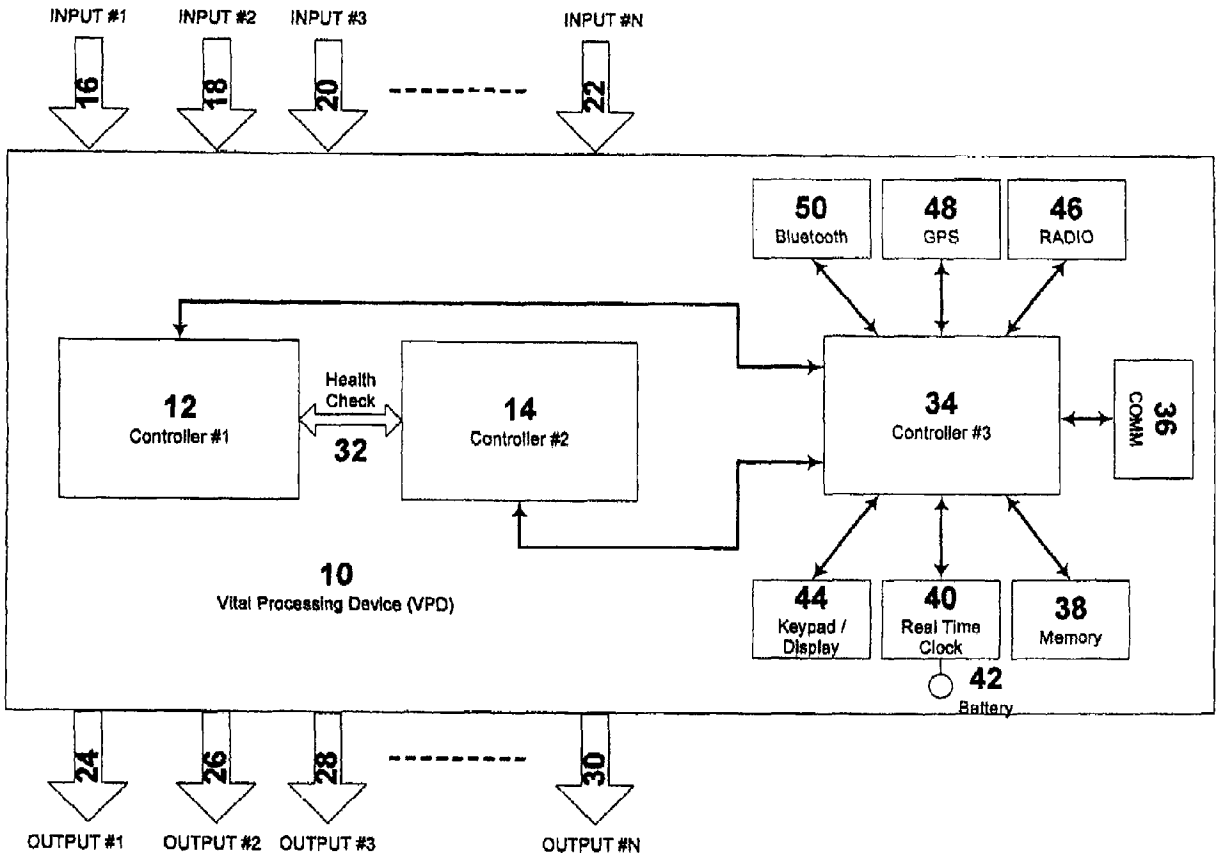
FIG. 1 shows a block diagram of the vital processing device (VPD) in accordance with at least one embodiment of the invention.
Figure 2:
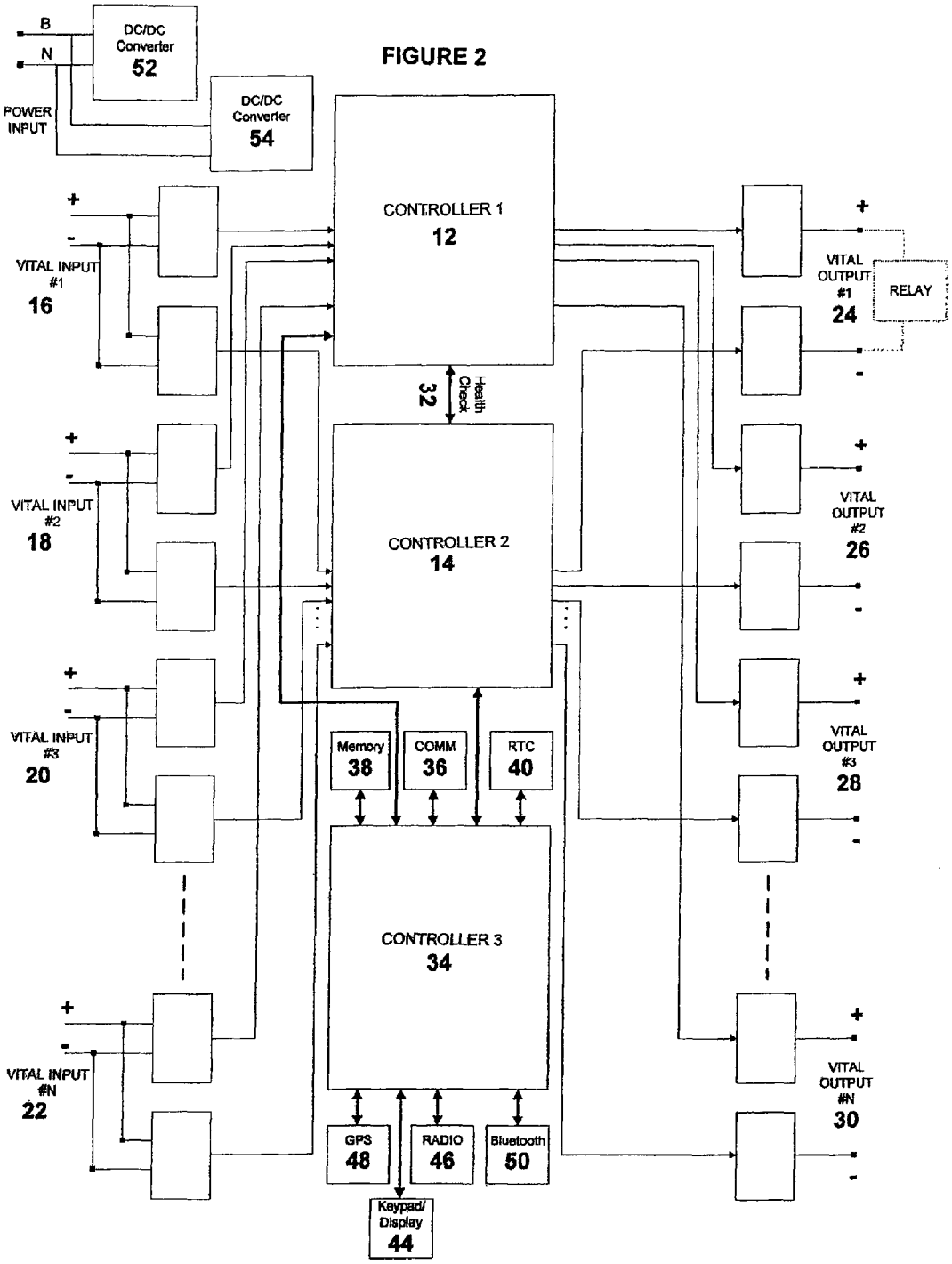
FIG. 2 is an alternative embodiment block diagram of the VPD of FIG. 1.

Referring to FIGS. 1-2. In one aspect of the invention, a vital solid state processing device (VPD) 10 is provided. The device 10 includes a first controller 12, second controller 14, a first vital input 16, a second vital input 18, a third vital input 20, an optional fourth vital output 22, a first vital output 24, a second vital output 26, a third vital output 28, an optional fourth vital output 30, a health check line 32 and a third controller 34. Alternatively, greater than 3 vital input and vital output lines can be employed. The number of vital inputs and vital outputs is determined by the specific application requirements, and can be greater than about 3 inputs and 3 outputs depending upon the specific use requirements of the device 10. The device can be configured to provide independent and redundant processing of input states thereby configured such that the VPD output is not logically high if any hardware or component in the path between the output and the associated input is damaged, missing, or otherwise nonfunctional.

The device 10 also includes a communication port 36, memory module 38, real time clock (RTC) 40, battery 42 for back up power, a user interface 44, a radio module 46, GPS module 48, and a Bluetooth module 50 operably connected to the third controller 34, and alternatively operably connected to the first controller 12, second controller 14, or a combination of the three controllers 12, 14, 34.

The inputs 16, 18, 20, and 22 represent signals received from vital railroad relays (not shown) or alternative signal sources. Railroad relays are often existing devices connected to most railroad tracks. The relays are located near railroad grade crossings and can be utilized for active grade crossing warning systems. The device 10 outputs 24, 26, 28, 30 represent the vital outputs from the system 10 to system devices (not shown) such as, by example, drive relays and warning signals, which can include active grade crossing devices. In the system 10 default position, the grade crossing devices (not shown) are not activated when the outputs 22, 24, 26 are energized. Any of the outputs 24, 26, 28, 30 can be assigned to provide an output which corresponds to the health check line 32. Alternatively, the controllers 12, 14, 34 can be suitable microprocessors known within the art.

The two independent controllers 12, 14 of the system independently receive the same vital inputs 16, 18, 20, 22 and execute the timing functions, resulting in the outputs 24, 26, 28, 30. The controllers 12, 14 are completely redundant. In an alternative embodiment, the controllers 12, 14 can be logically redundant while having the capability to perform non-redundant processes. In yet another alternative embodiment, the system 10 can have more than two redundant controllers, and by example have three or four redundant controllers. The third controller 34 is operably connected to the first and second controllers 12, 14 and is configured to execute and control the housekeeping functions of the system 10. By example, housekeeping functions can include system data logging to memory 38, external communication and various other system functions. The third controller 34 is operably connected to and in communication with the GPS module 48 and Bluetooth module 50. Access to the system 10 can be password protected in order to prevent unwarranted access. The controllers 12, 14, 34 each can be a single processor package, or alternatively be multiple processors. Alternatively, the system 10 can provide redundant processing of all vital inputs and complementary control of vital outputs (FIG. 2), the device 10 being configured for vitality.

The user interfaces with the system 10 by providing input to the system via the interface 44. The user can choose to set the device timing parameters, login to the device, change the device authorization, initiate data log collection, display the logic states or display the state of the device. The interface 44 provides the user the ability to select varying operation parameters of the system 10 depending upon the particular characteristics of the signaling devices or grade crossing for which it serves. The memory module 38 can be used to store logged data identifying vital timing states. The communication devices 36, 46, 48, 50 can be employed to show real time device activity and remotely retrieve logged data, in addition to other interface connectivity purposes with the device 10.

The VPD 10 can be operably connected to a computer or suitable computing device (not shown) through communication port 36. A user can access the device 10 through the computer's graphical user interface, allowing the user to access various parameters and system functions of the device 10. By example, the user can, among other functions, login into the device, change access authorization, initiate data collection and logging, download device data logs, display the logic states of the device 10, access current or historical data states of the device 10, change device clock and view device data logs. Communication with the system 10 can be configured through the communication port 36, which by example, can be a USB port, an Internet port, or a file writer. System users can select operation parameters of the system 10 depending upon the particular application program and system applications. Logged data, including vital timing states, can be saved to the memory module 38. Multiple VPDs 10 can communicate with each other through the communication means 36, 46, 48, 50, as well as through a hardwire connection. Communication between VPDs 10 can include system data sharing and coordinated operation of devices 10, which can be operably connected to one or more networks.

Figure 3:
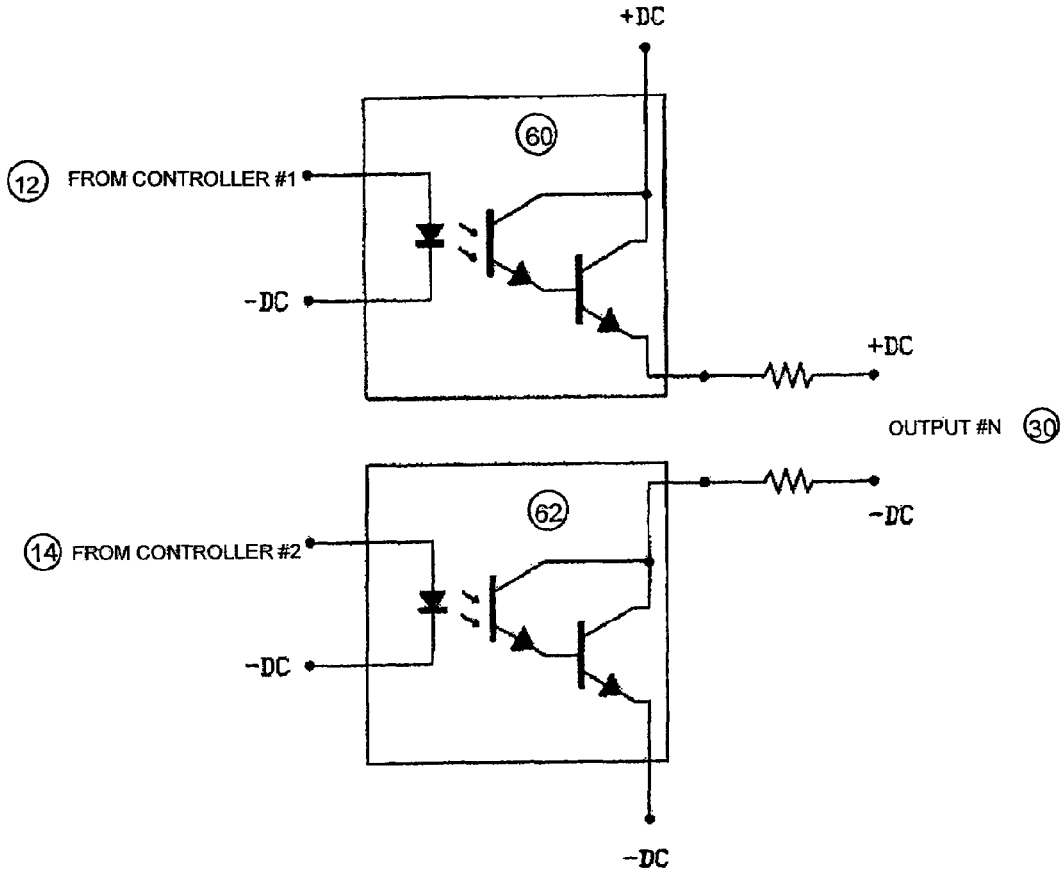
FIG. 3 is a schematic block diagram representing the device output control in accordance with at least one embodiment of the present invention.

Referring to FIG. 3, the output of microprocessor 12 controls a dedicated relay driver circuit 60 that provides positive referenced energy to the positive terminal of the output 30. The output of microprocessor 14 controls a dedicated relay driver circuit 62 that provides negative referenced energy to the negative terminal of output 30. Should the VPD 10 application program make output 30 directly dependent upon the condition of input 16, the following conditions are employed: 1) Input 16 is connected to the first microprocessor 12 and to the second microprocessor 14 and the intervening components and connections are functional. The components and connections from input 16 to microprocessor 12 are independent of the connections from input 16 to microprocessor 14 to maintain fill redundancy. 2) Microprocessor 12 executes the same application program as microprocessor 14. 3) The operating clock of microprocessor 12 coincides with the operating clock of microprocessor 14 and the operating clock of microprocessor 14 coincides with the operating clock of microprocessor 12. 4) The positive relay driver circuit 60 and terminal of output 30 are connected to microprocessor 12. The negative relay driver circuit and terminal of output 30 is connected to microprocessor 14. Damage to or failure of any component in the input or output circuit of either microprocessor or the failure of either of the microprocessors will result in no energy at output 30 regardless of the status of input 16. Output 30 will be energized only if input 16 is energized and the VPD 10 is operating properly.

In an alternative embodiment, an output 24, 26, 28, 30 can represent a signal to a preemption signal device (not shown). When the output 24, 26, 28, 30 is de-energized the preemption signal device is activated. Preemptive signal devices include, by example, flashing light signals and other methods to warn motor vehicle operators that grade crossing signals will shortly be activated. The preemption signal devices are activated based upon a timing protocol that is predetermined by the system 10 user. Grade crossings are located in a wide variety of locations and under varying circumstances. Grade crossings can be in close proximity to alternate vehicle intersections, grade crossings can be located at varying distances from each other, and the location of the crossing can be with in an area of the railroad tracks that consistently has high or low speed locomotives.

In an alternative embodiment, a system output represents a signal to a crossing control device, by example, this can include mechanical devices for impeding vehicle traffic and flashing light signals used to prevent vehicles from traveling across a grade crossing when a locomotive is approaching. The control devices are representative of active warning systems known in the art. Active warning systems that impede traffic from traveling through the crossing are not utilized at all railroad grade crossings. At least one embodiment of the present invention provides a cost effective and novel system that will provide a solution for placing active preemptive warning systems at crossings that are currently limited to passive warning systems.

A VPD 10 application program can provide multiple independent and programmable timers convenient to systems control applications. A timer example application in which the condition of an assigned output corresponding to a specific input is delayed by either a predetermined or user selected value for the purpose of eliminating the unwanted effects of intermittent interruption of the input signal are contemplated. A further example is a timer application in which the condition of the assigned output(s) corresponding to specific inputs or sequential input changes, is maintained for a specific period or interrupted after a specific period. The period length can be either a programmed fixed variable or a user input variable.

Alternatively, the VPD 10 application program can identify and process sequential input changes to control conditions of assigned outputs. By example, the application compares the sequential status of two or more inputs to determine the condition of an assigned output. This feature allows the VPD 10 to provide a logical output that corresponds to directional movement of a vehicle, such as a locomotive or motor vehicle.

The VPD 10 can be configured to provide vital control for any control system application. The VPD 10 can be configured to provide single vital input control of multiple vital outputs. The VPD 10 can also be configured to allow a user to specify the sequence, delay, dependence or independence of controlled outputs. There is no limit to the number of software timers or alarms that can be defined. The VPD 10 utilizes redundant microprocessors 12, 14, each running the same application and each checking the health of the other processor to ensure integrity and vitality. The application program assigns the condition of specific outputs to be dependent upon the condition of specific inputs. The application program incorporates timers and sequential logic to define the input-output relationship. Each output provides a discrete positive and negative. Each output is hardware independent and electrically isolated from every other output. Each microprocessor receives identical information from each input and each microprocessor executes the same application program logic. Furthermore, the output of microprocessor 12 is identical to the output of the microprocessor 14.

In at least one embodiment of the present invention, the VPD 10 can be programmed by the user for a particular application through use of a Ladder Logic based programming Integrated Development Environment (IDE). The IDE provides advanced ladder logic editing, compiling, debugging, assembly and program download features. The editor, or system user, can provide a set of configurable blocks which can be arranged into a ladder logic program. These blocks can include Normally Open, Normally closed, Timers, Counters, Set, Reset, Single Output Up, Single Output Down, Data Move, Data Comparison, Data Conversion, Data Display, Data Communication and Binary Arithmetic tools. The editor also provides rich editing and ladder formatting tools. The compiler checks for syntax errors in the ladder program and generates mnemonics in case there are no syntax errors. The Assembler converts the program into a device specific hex file which is downloaded into the device using the program downloader built into the IDE. The ladder logic programming can also offer advanced debugging features for this dual controller based vital processing device. It can be configured for step by step debugging with real-time updates on the ladder blocks.

Figure 4:
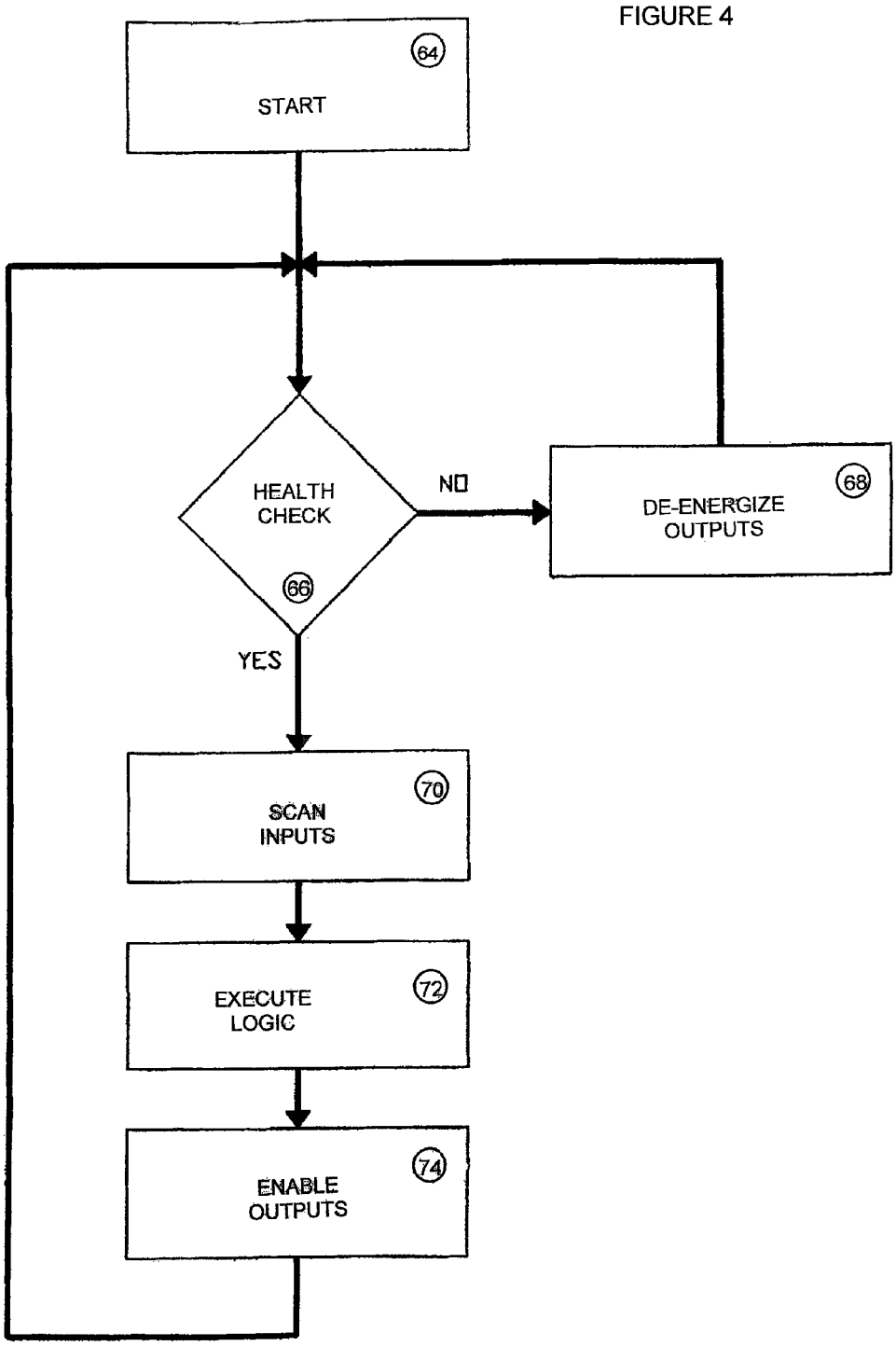
FIG. 4 is a flow diagram of a health check protocol in accordance with at least one embodiment of the present invention.

Now referring to FIG. 4, an embodiment of the VPD 10 input and output scheme is provided. From the VPD start position 64 the health check protocol is initiated at step 66. If the health check is not confirmed then all outputs are de-energized at step 68. As a result of the outputs being de-energized the safest state of the VPD 10 occurs, and energy to any vital device controlled by any of the VPD 10 is removed. Deactivation of the VPD outputs in the event of a failed VPD health check 66 is consistent with the failsafe principles of the VPD 10. Subsequently, the VPD 10 identifies whether any input 16, 18, 20, 22 is energized at step 70. The application program is executed 72 and outputs are energized 74 consistent with the condition of the inputs mediated by the program logic. The VPD 10 then loops back to the health check step 66.

One system output 26 represents the result of the health check protocol that is executed by each of the controllers 12, 14. Output 26 is dedicated to vital relays with the purpose of indicating system 10 vitality. The controllers check the operations parameters through a health check monitor 32. The health check protocol is designed to monitor and compares the clock frequencies for each of the controllers. In the event that the clock frequencies of the two controllers are not consistent, the health check protocol causes the output 26 to become de-energized. Alternatively, if the monitoring function of the health check protocol identifies a problem with one or both of the controllers then output 26 is de-energized. In most situations the health check parameters are satisfied and output 26 remains energized. In the present embodiment, the health check is constantly maintained by the redundant controllers 12, 14 by exchanging precisely timed heartbeats.

In an alternative embodiment, a health-check protocol is executed separately by two independent microprocessors 12, 14. The health check protocol is configured to monitor and compare the clock frequencies for each of the controllers 12, 14, 34. In the event that the clock frequencies of the two controllers are not consistent, the health check protocol causes one of the designated vital outputs to become de-energized. Alternatively, if the monitoring function of the health check protocol identifies a problem with one or both of the microprocessors then health check output is de-energized. During normal system 10 operating conditions, the health check parameters are satisfied and the health check output remains energized. In the present embodiment, the health check is constantly maintained by the redundant controllers 12, 14 by exchanging precisely timed heartbeats.

Figure 5:
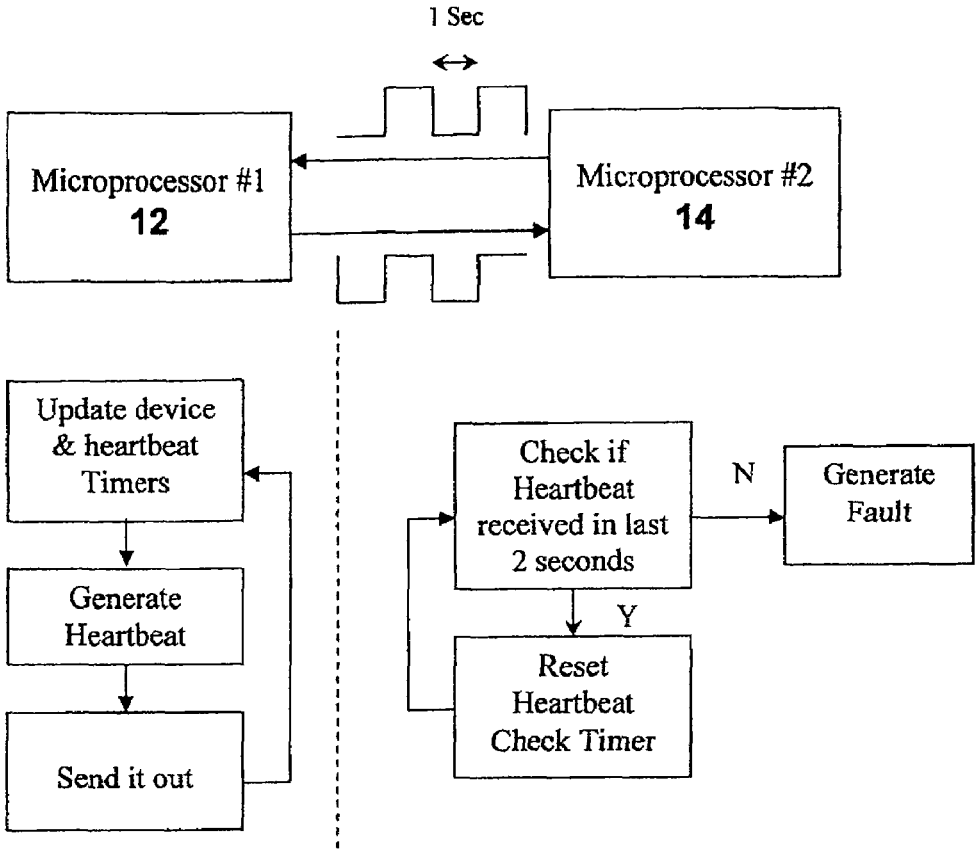
FIG. 5 is a graphical representation of a system input/output schema in accordance with at least one embodiment of the invention.

Now referring to FIG. 5, an embodiment of the VPD 10 health check scheme is described. The microprocessors 12 and 14 exchange an independently generated, precisely timed heartbeat clock which can have a time period of 1 second. The health check protocol is designed to keep check on the performance of timers and events that form the basis of any operational logic of an application. Delays and variations in timers' execution can result in compromise of the device vitality. Various hardware, software and environmental conditions pertaining to the device can result in timer variations and hence the dual redundant nature of the design of the VPD 10 is configured to address and counter such discrepancies. A Master timer in each microprocessor is used to update the heartbeat and other program timers simultaneously. Any shift in the Master timer will result in proportional drift in the heartbeat timer as well as other program timers. Both microprocessors will monitor this drift and upon exceeding a defined limit will generate a fault condition. Accurate timer operations ensure vital device operation.

In an alternative embodiment, the VPD 10 has an onboard GPS module for providing location, speed and direction of travel information. The microprocessor 34 requests the information from the GPS receiver through a communication port 36 (by example, serial RS232) and forwards it to the microprocessors 12 and 14. The information about speed, location and travel direction can be used by in a number of ways by the device depending on the application at hand. Bluetooth module 50 provides authenticated short range two way communication with a laptop, PDA, Smartphone, keypad or alternative mobile computing device. The Radio module 46 can be used for communication with a remote device, another VPD or other devices communicating on the same radio band. A graphical user interface discussed earlier can be used for changing the VPD 10 parameters. This user interface can be used on a laptop as well as a PDA or a Smartphone through the Bluetooth module 50 for parameter updates. A commercially available Bluetooth keypad/keyboard can be paired up with the VPD Bluetooth module 50 to provide user input options for a certain application.

In an alternative embodiment, the system 10 is configured to provide advance preemption and crossing signal control logic from the same track relay circuit. The system 10 further provides multiple independent and programmable loss of shunt timers in a single device. Additionally, the system 10 provides directional logic and programmable release timer functions in a single device.

Figure 6:
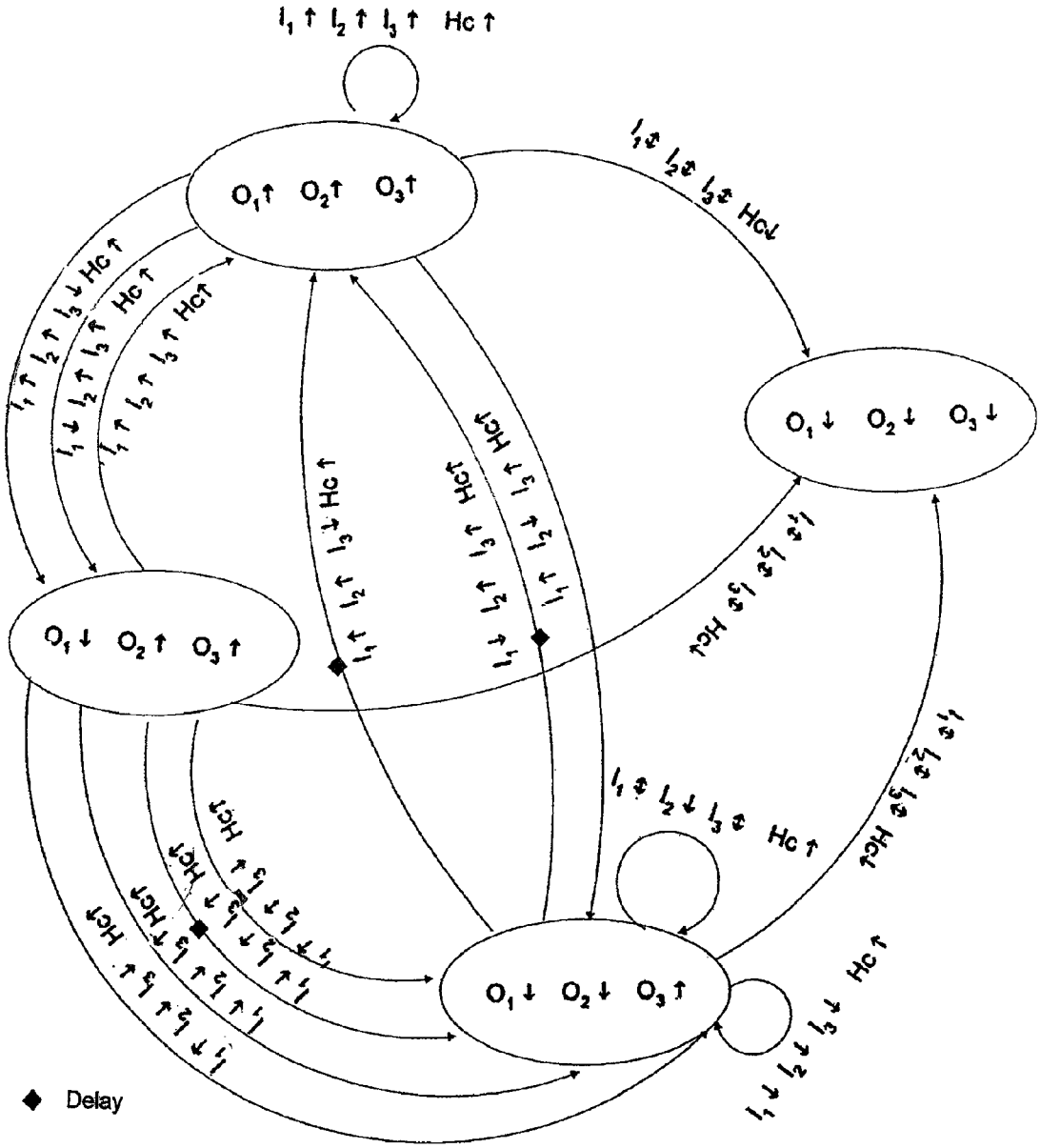
FIG. 6 is a timing diagram representing a state of the system based upon the input and output of the system, in accordance with at least one embodiment of the invention.

Now referring to FIG. 6, an alternative embodiment of the timing function is depicted. The user can select from several timing functions, rather than a pre-selected timing function. By example, a first timing function is a delay timer for output 24, which delays the operation of a crossing control with respect to the operation of preemption signals. An output delay timer is initiated by one of two situations, when input 16 or input 24 are de-energized. Upon the completion of the delay timer, output 24 is de-energized. The duration of this timer is user programmable and can be dependent upon a specific type of crossing. By example, a track section can receive fast moving trains, therefore it is necessary to delay the crossing control device for a shorter period of time than a track section that can receive slower moving trains. In an alternative embodiment, the system 10 can dynamically adjust the delay duration based upon the information received from the track relays on the inputs 16, 18, 20.

A second timing function can include an input interrupt delay timer. When any de-energized input is energized, an input interrupt delay timer that is dedicated to that specific input is initiated. The duration of this timer can be user programmable to increase the adaptability of the system. Regarding the timer, the input change is not processed until the timer has elapsed.

A third timing function can include an input sequence delay output timer. Upon the failure of either microprocessor to pass the health check protocol, energy is removed from all outputs. A sequence delayed output timer is initiated when inputs have been de-energized in two specific sequences: input 18, then input 16 de-energized followed by input 18 energized; or input 18, then input 20 de-energized followed by input 18 energized. Once the sequence delayed output timer is initiated output 24 and output 26 are energized upon reenergizing input 18. The sequence delay output timer can be user programmable.

During the operation of the sequence delay output timer the system will function as follows: input 20 and input 18 are energized and input 16 is de-energized. Output 24, output 26 and output 28 are also energized. Alternatively, input 16 and input 18 are energized and input 20 is de-energized and output 16, output 18 and output 20 energized. Upon the completion of the sequence delay output timer, if input 16 or input 20 is de-energized, then output 24 and output 26 are immediately de-energized. If all inputs are energized before completion of the sequence delay timer, output 24 and output 26 remain energized.

In an alternative embodiment of the system 10, isolated vital input and output relay terminals are included. This will allow for the system 10 to be retrofit into pre-existing grade crossings.

In at least one embodiment, the vital timing device 10 can be configured with at least four vital inputs and four vital outputs. The number of inputs is greater than the number of outputs, as each vital output has an associated input as a feedback to check the actual operation of the device attached to the corresponding output. The device has a small time window to confirm the agreement between a Vital Output and the associated feedback Input. Alternatively the device has less than four inputs and less than four outputs. In an alternative embodiment there are greater than four inputs and greater than 4 outputs.

In at least one embodiment of the present invention, the system 10 is designed for a railroad signal environment to perform vital signal functions. The primary application for the device is to enable the use of a single conventional track relay circuits to provide advance preemption of highway traffic light signals and initiate operation of highway-railroad grade crossing signals. In this application, the system 10 enhances the operational safety of the conventional circuit by providing vital loss of shunt timer function for each track relay input. The system 10 provides train movement directional logic, thereby eliminating at least two vital railroad relays and provides a vital directional logic release timer function which causes the crossing signals to operate should the receding track relay circuit fail to recover within a predetermined time following a train movement. In an alternative embodiment, the system 10 can be configured for a variety of control systems. By example, the system 10 can be configured for roadway motor vehicle traffic control systems. In yet another alternative embodiment, the system 10 can be configured for control systems not associated with vehicle detection, but where a cost effective vital logic controller system is advantageous.

Where traffic light signal preemption is necessary, any conventional signal track circuit or motion sensor is adequate to simultaneous preemption of the traffic light signals with the activation of the railroad crossing signals. Where it is desired for motor vehicle traffic light signal preemption to begin in advance of the operation of the railroad crossing signals, the only device available which also provides motion sensing features is a constant warning device with auxiliary programmable modules. As a result, the conversion from simultaneous to advance traffic signal preemption requires replacement of the motion sensor with a grade crossing predictor. The system 10 provides another solution. If the system 10 is controlled by the motion detector relay, the VPD can be programmed to provide a fixed amount of delay prior to the interrupt of the vital output which controls the operation of the railroad crossing signals. The system 10 vital output controlling the traffic light signals would initiate preemption as soon as the motion detector relay input is removed from the system 10. Railroad rules require that trains stopped or delayed in the approach to a crossing equipped with signals can not occupy the crossing until the signals have been operating long enough to provide warning (GCOR, $5^{th}$ Ed.—6.32.2). Because of this rule the VPD provides a feature for advance preemption of traffic light signals that is not available from constant warning devices: advance preemption time, that is, the time between the initiation of traffic light signal preemption and operation of crossing signals is a constant and always the same regardless of train position. Constant warning devices do not provide this feature. When a train is delayed or stopped or reverses direction and then resumes approach to the crossing at a distance from the crossing that is at or less than the programmed required warning time for the crossing signals, as calculated by the constant warning device traffic light signal preemption is simultaneous. If the distance from the train to the crossing exceeds the crossing programmed warning time calculation the amount of advance preemption time is reduced proportional to the distance of the train from the crossing when it resumes its approach.

It is specifically intended that the present invention not be limited to the embodiments and illustrations contained herein, but include modified forms of those embodiments including portions of the embodiments and combinations of elements of different embodiments as come within the scope of the following claims.

The invention claimed is:

1. An apparatus comprising a vital processing device coupled to a railroad signaling device coupled to a railroad track, the vital processing device configured to receive an input signal set comprising one or more input signals representing one or more conditions on the railroad track, the vital processing device comprising:

a first controller device configured to perform a first logic process using the input signal set to generate a first controller device output signal;

a second controller device configured to perform the first logic process using the input signal set to generate a second controller device output signal; and health check apparatus configured to perform integrity testing of the first and second controller devices;

wherein the first and second controller devices do not share components affording alternative energy or logic paths;

further wherein the vital processing device sets the railroad signaling device to a railroad signaling device safest condition if at least one of the following occurs:

failure of one or more components of the vital processing device;

integrity testing failure by the first controller device;

integrity testing failure by the second controller device; and further wherein, when the first and second controller devices both pass integrity testing, and when there is no component failure within the vital processing device, the first and second controller device output signals are identical, are a function of the input signal set, and are used to control the railroad signaling device;

a first dedicated relay driver circuit coupled to receive the first controller device output signal, wherein the first dedicated relay driver circuit enables a current generating a first discrete DC voltage signal when the first controller device output signal is high and further wherein the first dedicated relay driver circuit prevents current flow to generate any DC voltage signal when the first controller device output signal is low; and a second dedicated relay driver circuit coupled to receive the second controller device output signal, wherein the second dedicated relay driver circuit enables a current generating a second discrete DC voltage signal when the second controller device output signal is high and further wherein the second dedicated relay driver circuit prevents current flow to generate any DC voltage signal when the second controller device output signal is low;

wherein the first and second discrete DC voltage signals are required to produce a current flow and voltage differential to energize a relay in the railroad signaling device;

further wherein the first dedicated relay driver circuit comprises an emitter follower transistor configuration, and further wherein the second dedicated relay driver circuit comprises an emitter follower transistor configuration.

2. The apparatus of claim 1 wherein the first and second controller devices are:

a pair of duplicate microprocessors;

a pair of duplicate programmable devices;

two microprocessors programmed to perform duplicate logic processing;

two programmable devices programmed to perform duplicate logic processing; or identical, distinct logic devices.

3. The apparatus of claim 1 wherein the first dedicated relay driver circuit comprises an opto-isolator configuration, and further wherein the second dedicated relay driver circuit comprises an opto-isolator configuration.

4. The apparatus of claim 1 wherein the vital processing device is further comprising a third controller device coupled to the first and second controller devices, wherein the third controller device performs one or more of the following:

controlling housekeeping functions for the first and second controller devices;

permitting communications with a computer external to the vital processing device;

permitting communications with one or more other vital processing devices;

providing a user interface to control one or more of the following:

setting vital processing device timing parameters;

logging in to the vital processing device;

changing vital processing device authorization;

initiating data log collection;

device data logging and retrieval;

displaying logic states;

displaying one or more vital processing device states;

setting vital processing device operating parameters;

providing memory for storing data regarding the vital processing device.

5. The apparatus of claim 1 wherein each input signal is a vital railroad track relay signal.

6. The apparatus of claim 1 wherein the first and second controller devices are configured to provide independent and redundant processing of the input signal set.

7. The apparatus of claim 1 wherein the railroad signaling device comprises at least one of the following: a railroad track crossing warning device; a preemption signal device; a railroad track traffic status indicator, wayside signals, power switch control device, directional movement logic.

8. The apparatus of claim 1 wherein the health check apparatus comprises a pair of health check lines coupling the first controller device coupled to the second controller device, and further wherein integrity testing comprises at least one of the following:

monitoring independently generated, timed heartbeats of the first controller device and independently generated, timed heartbeats of the second controller device;

comparing independently generated, timed heartbeats of the first controller device and independently generated, timed heartbeats of the second controller device;

identifying a problem with at least one of the first and second controller devices using independently generated, timed heartbeats of the first controller device and independently generated, timed heartbeats of the second controller device.

9. The apparatus of claim 8 wherein the railroad signaling device comprises at least one of the following: a railroad track crossing warning device; a preemption signal device; a railroad track traffic status indicator, wayside signals, power switch control device, directional movement logic.

10. The apparatus of claim 9 wherein the first and second controller devices are:

a pair of duplicate microprocessors;

a pair of duplicate programmable devices;

two microprocessors programmed to perform duplicate logic processing;

two programmable devices programmed to perform duplicate logic processing; or identical, distinct logic devices.

11. The apparatus of claim 8 wherein the first and second controller devices are configured to provide independent and redundant processing of the input signal set.

12. An apparatus comprising a vital processing device coupled to a railroad signaling device coupled to a railroad track, the vital processing device configured to receive an input signal set comprising one or more input signals representing one or more conditions on the railroad track, the vital processing device comprising:

a first controller device configured to perform a first logic process using the input signal set to generate a first controller device output signal;

a second controller device configured to perform the first logic process using the input signal set to generate a second controller device output signal; and health check apparatus configured to perform integrity testing of the first and second controller devices;

wherein the first and second controller devices do not share components affording alternative energy or logic paths;

further wherein the vital processing device sets the railroad signaling device to a railroad signaling device safest condition if at least one of the following occurs:

failure of one or more components of the vital processing device;

integrity testing failure by the first controller device;

integrity testing failure by the second controller device; and further wherein, when the first and second controller devices both pass integrity testing, and when there is no component failure within the vital processing device, the first and second controller device output signals are identical, are a function of the input signal set, and are used to control the railroad signaling device;

wherein the health check apparatus comprises a pair of health check lines coupling the first controller device coupled to the second controller device, and further wherein integrity testing comprises at least one of the following:

monitoring independently generated, timed heartbeats of the first controller device and independently generated, timed heartbeats of the second controller device;

comparing independently generated, timed heartbeats of the first controller device and independently generated, timed heartbeats of the second controller device;

identifying a problem with at least one of the first and second controller devices using independently generated, timed heartbeats of the first controller device and independently generated, timed heartbeats of the second controller device.

13. The apparatus of claim 12 wherein the vital processing device is further comprising a third controller device coupled to the first and second controller devices, wherein the third controller device performs one or more of the following:

controlling housekeeping functions for the first and second controller devices;

permitting communications with a computer external to the vital processing device;

permitting communications with one or more other vital processing devices;

providing a user interface to control one or more of the following:

setting vital processing device timing parameters;

logging in to the vital processing device;

changing vital processing device authorization;

initiating data log collection;

device data logging and retrieval;

displaying logic states;

displaying one or more vital processing device states;

setting vital processing device operating parameters;

providing memory for storing data regarding the vital processing device.

14. The apparatus of claim 12 wherein each input signal is a vital railroad track relay signal.

15. The apparatus of claim 12 wherein the first and second controller devices are configured to provide independent and redundant processing of the input signal set.

16. The apparatus of claim 12 wherein the railroad signaling device comprises at least one of the following: a railroad track crossing warning device; a preemption signal device; a railroad track traffic status indicator, wayside signals, power switch control device, directional movement logic.

17. The apparatus of claim 12 wherein the first and second controller devices are:

a pair of duplicate microprocessors;

a pair of duplicate programmable devices;

two microprocessors programmed to perform duplicate logic processing;

two programmable devices programmed to perform duplicate logic processing; or identical, distinct logic devices.

* * * * *